US006694957B2

(12) United States Patent
Schueler et al.

(10) Patent No.: US 6,694,957 B2
(45) Date of Patent: Feb. 24, 2004

(54) MULTI-ORIFICE NOZZLE AIR EVACUATOR ASSEMBLY FOR A VENTILATION SYSTEM OF A DIESEL ENGINE

(75) Inventors: Joshua D. Schueler, New Lenox, IL (US); Gary R. Svihla, Chicago, IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/243,272

(22) Filed: Sep. 13, 2002

(65) Prior Publication Data

US 2003/0213480 A1 Nov. 20, 2003

Related U.S. Application Data

(63) Continuation-in-part of application No. 10/146,618, filed on May 15, 2002.

(51) Int. Cl.[7] ..... F02B 25/06
(52) U.S. Cl. ..... 123/572
(58) Field of Search ..... 123/572, 573, 123/574, 41.86; 60/283

(56) References Cited

U.S. PATENT DOCUMENTS 16,456 A 1/1857 Wright
1,176,627 A * 3/1916 Ver Planck ..... 123/572
1,828,085 A * 10/1931 Syrovy et al. ..... 123/572
3,063,440 A * 11/1962 Tuzzalino ..... 123/572
4,197,703 A 4/1980 Holmes
4,557,226 A 12/1985 Mayer et al. ..... 123/41.86
5,803,025 A * 9/1998 Feucht ..... 60/283
6,167,874 B1 * 1/2001 Becker et al. ..... 123/572

OTHER PUBLICATIONS

Patent Abstracts of Japan, vol. 013, No. 202 (M–824), Japanese Publication No. 01024106 published Jan. 26, 1989.

* cited by examiner

*Primary Examiner*—Marguerite McMahon
(74) *Attorney, Agent, or Firm*—Cary W. Brooks

(57) ABSTRACT

A multi-orifice crankcase air evacuator assembly for a diesel engine which provides improved efficiency and effectiveness of crankcase air removal into the exhaust port of the engine. A multi-orifice nozzle preferably has five nozzle orifices arranged in an "X" pattern. The evacuation tube has a tube body defining a central passage and a bell-mouth concentrically disposed at its inlet. The central passage includes an air mixer and an air diffuser. Operatively, compressed air pressurably effuses from the nozzle orifices into the central passage, whereupon a low pressure region is established surrounding the bell-mouth which causes crankcase air to be sucked into the evacuator tube and thereupon be expelled to an exhaust port.

15 Claims, 5 Drawing Sheets

MULTI-ORIFICE NOZZLE AIR EVACUATOR ASSEMBLY FOR A VENTILATION SYSTEM OF A DIESEL ENGINE

This application is a continuation-in-part of U.S. Ser. No. 10/146,618 filed May 15, 2002.

TECHNICAL FIELD

The present invention relates to crankcase ventilation of diesel internal combustion engines, particularly diesel engines used for locomotive applications.

BACKGROUND OF THE INVENTION

Diesel powered locomotives generally require an absence of positive crankcase pressure. Yet, during the operation of internal combustion engines, blow-by gas from the combustion chamber during the combustion stroke causes a positive pressure in the crankcase which must be relieved. In the case of locomotive applications, it is desired that the crankcase generally be negatively pressured. Accordingly, since a simple valve or opening in the crankcase is inadequate, a crankcase ventilation system is utilized.

The crankcase ventilation system on a locomotive diesel engine evacuates the excessive crankcase air in the crankcase (from seals and piston blow-by) to the exhaust stream and eventually the atmosphere. Included in the crankcase air is an oil mist that has two negative consequences. First, the oil mist contributes to the engine's emissions; and second, the oil leaves a coke deposit of carbon that can ignite and start railside fires.

FIG. 1 exemplifies a conventional diesel engine crankcase ventilation system 10, including an oil separator 12 and an evacuator 14. A pipe connection 16 communicates generally horizontally with the crankcase, as for example at an upper portion of the oil pan 18. An elbow 20 connects the pipe connection 16 to the oil separator 12, which has an off-set opening 22. Connected to the off-set opening 22 is the evacuator 14. The evacuator 14 has a vertical portion 24 and a horizontal portion 26 demarcated by a bend 28. The end of the horizontal portion 26 is interfaced with an exhaust port 30 which communicates with the engine exhaust system. The bend 28 is fitted with a nozzle assembly 32. The nozzle assembly 32 includes a single orifice nozzle 34 internal to the horizontal portion 26 which is directed down the horizontal portion toward the exhaust port 26, the horizontal portion diameter outwardly tapering with increasing distance from the nozzle assembly. The nozzle assembly 32 is interfaced with a source of pressurized air external to the crankcase, via an air line 36.

In operation, pressurized air emanating from the nozzle blows air toward the exhaust port, causing a low pressure condition in the vertical portion of the evacuator. This low pressure zone communicates with the crankcase through the oil separator to cause crankcase air to be affirmatively evacuated from the crankcase. Oil-laden crankcase air passes through the oil separator, during which the expanded volume and vertical path combine to cause oil to precipitate out of the crankcase air and then flow back into the crankcase.

Several drawbacks of the conventional diesel engine crankcase ventilation system are yet in need of redress, among those being a need to improve the efficiency and effectiveness of crankcase air removal into the exhaust port.

SUMMARY OF THE INVENTION

The present invention is a multi-orifice crankcase air evacuator assembly for a diesel engine which provides improved efficiency and effectiveness of crankcase air removal into the exhaust port of the engine.

The multi-orifice crankcase air evacuator assembly includes a multi-orifice nozzle interfaced with an evacuator tube. The multi-orifice crankcase air evacuator assembly is located in a housing which communicates with a crankcase port of the engine so that crankcase air is freely movable into the housing at the multi-orifice crankcase air evacuator assembly. The multi-orifice crankcase air evacuator assembly, in turn, is connected to an exhaust port of the engine which communicates to the engine exhaust system.

The multi-orifice nozzle has a nozzle body connected to an external source of compressed air. The compressed air enters a nozzle chamber of the nozzle body. Connected with the nozzle body is a nozzle head having a number of nozzle orifices, preferably five, each communicating with the nozzle chamber. The nozzle orifices are mutually spaced in a symmetric arrangement (i.e., an "X" pattern) so as to collectively provide a generally circumferential area of air movement as the high pressure nozzle air rapidly effuses from the nozzle orifices.

The evacuation tube has a tube body defining a central passage and a bell-mouth concentrically disposed at its inlet, whereat the bell-mouth merges with the central passage to define thereat a throat. The bell-mouth has a generally mushroom shape characterized by an annularly distributed convex air guide surface. The central passage has a near portion adjacent the throat which serves as an air mixer and a distal portion that widens with increasing distance from the bell-mouth and which serves as an air diffuser. At the outlet, the tube body has a flange for interfitting with a connection to exhaust port of the engine.

Operatively, the nozzle orifices are located in alignment with the central passage, in close spaced proximity to the bell-mouth. As high pressure nozzle air exits the nozzle orifices, the respective high velocity nozzle air streams converge at the throat and pass rapidly along the central passage. This nozzle air movement creates a region of low pressure surrounding the bell-mouth. Consequently, crankcase air surrounding the bell-mouth is sucked into the throat at a large rate, and preferably in a generally laminar flow over the bell-mouth. The crankcase air mixes with the nozzle air streams in the near portion of the central passage, causing a momentum mixing therebetween which causes crankcase air to rapidly move with the air streams down the central passage. As this mixed air moves down the central passage, the distal portion of the central passage allows expansion and velocity reduction of the mixed air, whereupon the mixed air has generally achieved atmospheric pressure by the time it reaches the outlet.

The bell-mouth allows for crankcase air to be sucked into the throat over a 360 degree circumference, which contributes to a free and voluminous movement of the crankcase air into the throat. The near portion of the central passage provides an air mixing section where the nozzle air exchanges momentum with the crankcase air. The distal portion of the central passage serves as a diffuser which serves to recover kinetic energy in the mixed air flow stream. The multiple nozzle orifices provide better gas mixing and movement than can be provided by a single nozzle orifice, resulting in better momentum exchange, and reduction of external air capacity to achieve a similar amount of crankcase air pumping.

Accordingly, it is an object of the present invention to provide more efficient evacuation of crankcase air in connection with a crankcase air ventilation system of a diesel engine.

It is an additional object of the present invention to provide improved evacuation of crankcase air in connection with a ventilation system of a diesel engine, wherein a multi-orifice nozzle is coupled with an evacuator tube configured to provide efficient air entry, mixing and diffusion.

These and additional objects, features and advantages of the present invention will become clearer from the following specification of a preferred embodiment.

DESCRIPTION OF THE PREFERRED EMBODIMENT

Figure 1:
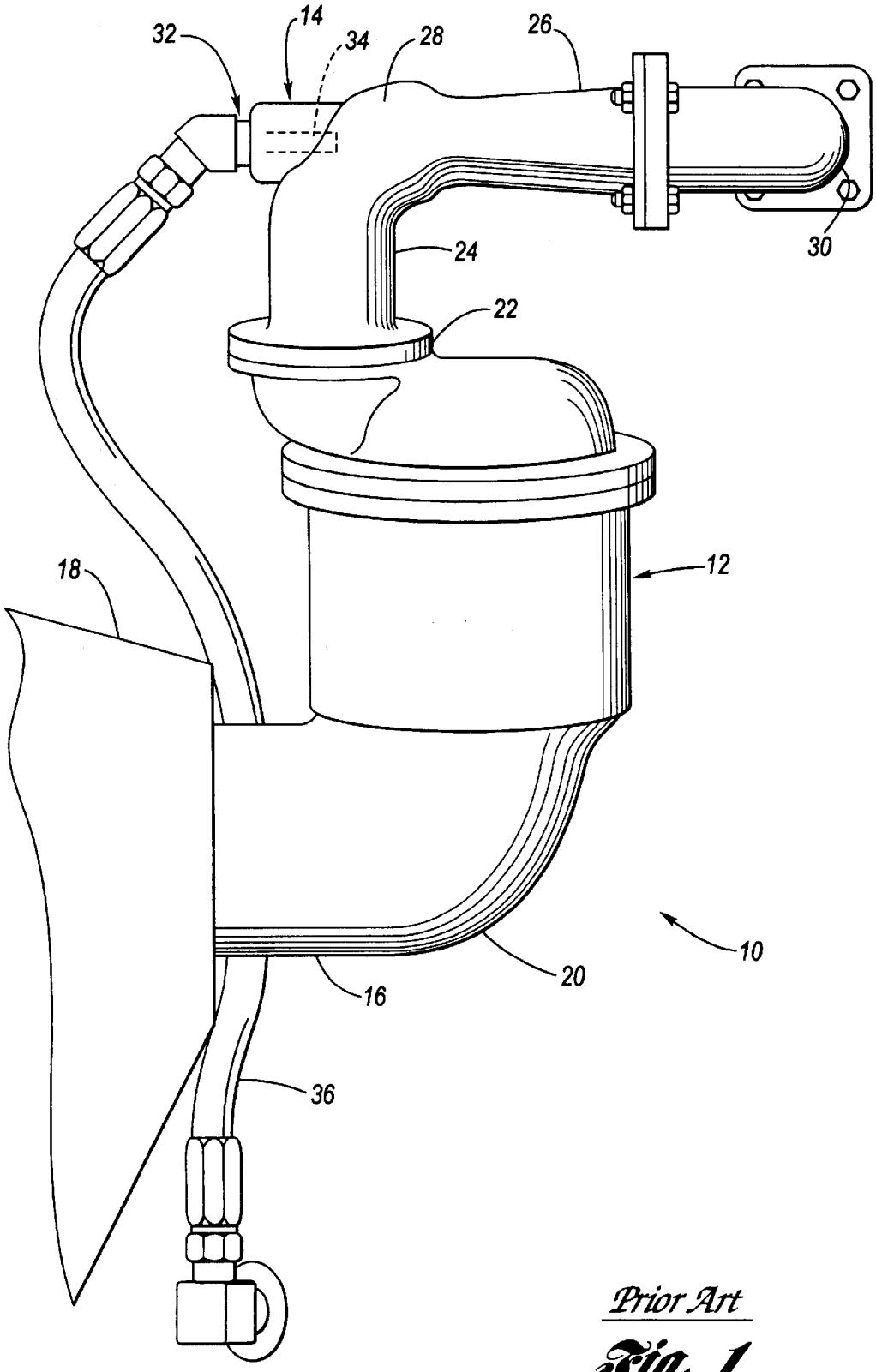
Prior Art Fig. 1
FIG. 1 is a side view of a conventional crankcase ventilation system for a diesel engine.

Referring now to the drawings, FIGS. 2 through 7B depict an example of a multi-orifice crankcase air evacuator assembly 100 according to the present invention, shown in conjunction with an oil separator 102 of a diesel engine 104. While the diesel engine 104, by way of exemplification, is used to power a locomotive, other similar applications may include, for example, power generation and marine applications.

Figure 2:
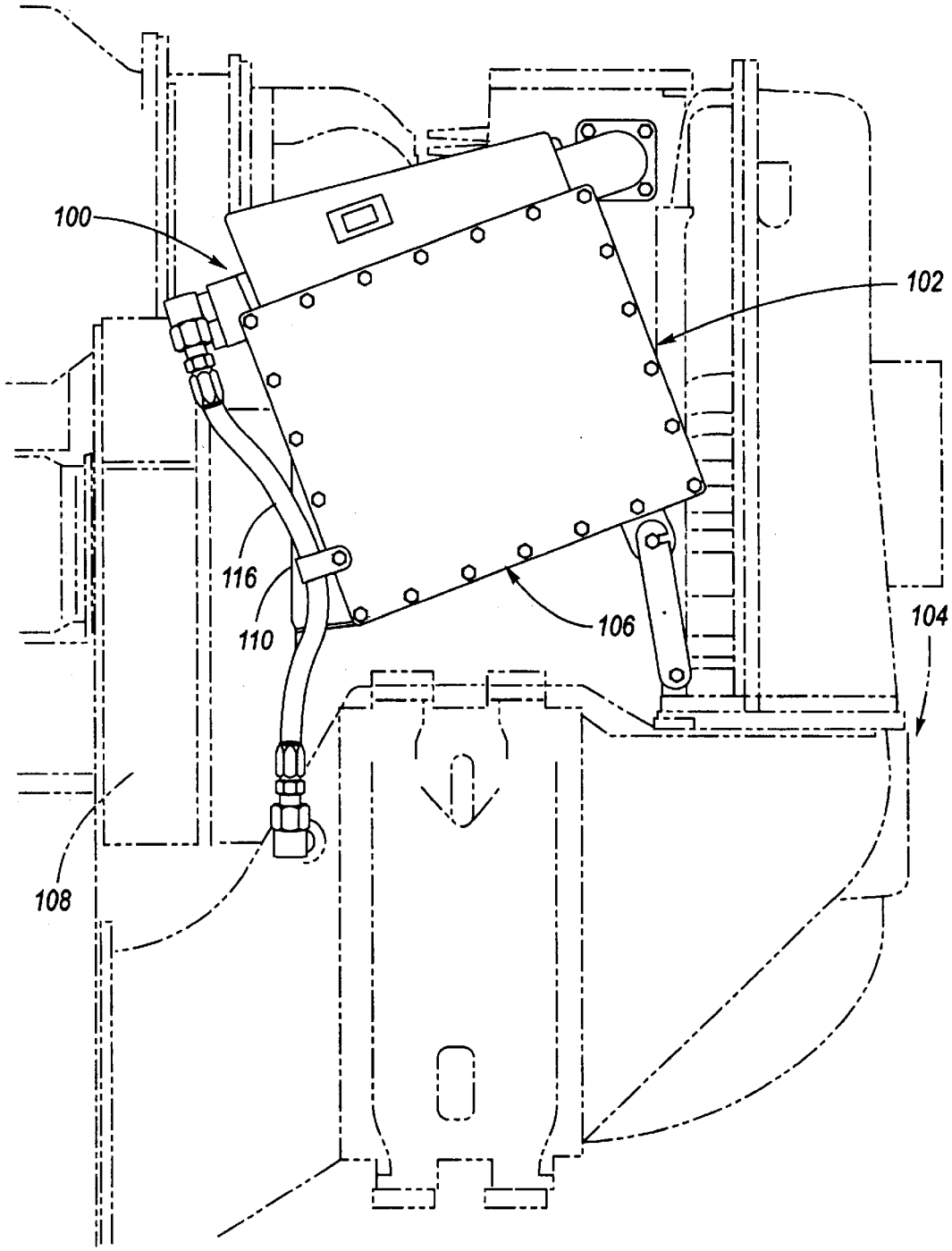
FIG. 2 is a side view of a crankcase ventilation system of a diesel engine including a multi-orifice crankcase air evacuator assembly according to the present invention.
Figure 3:
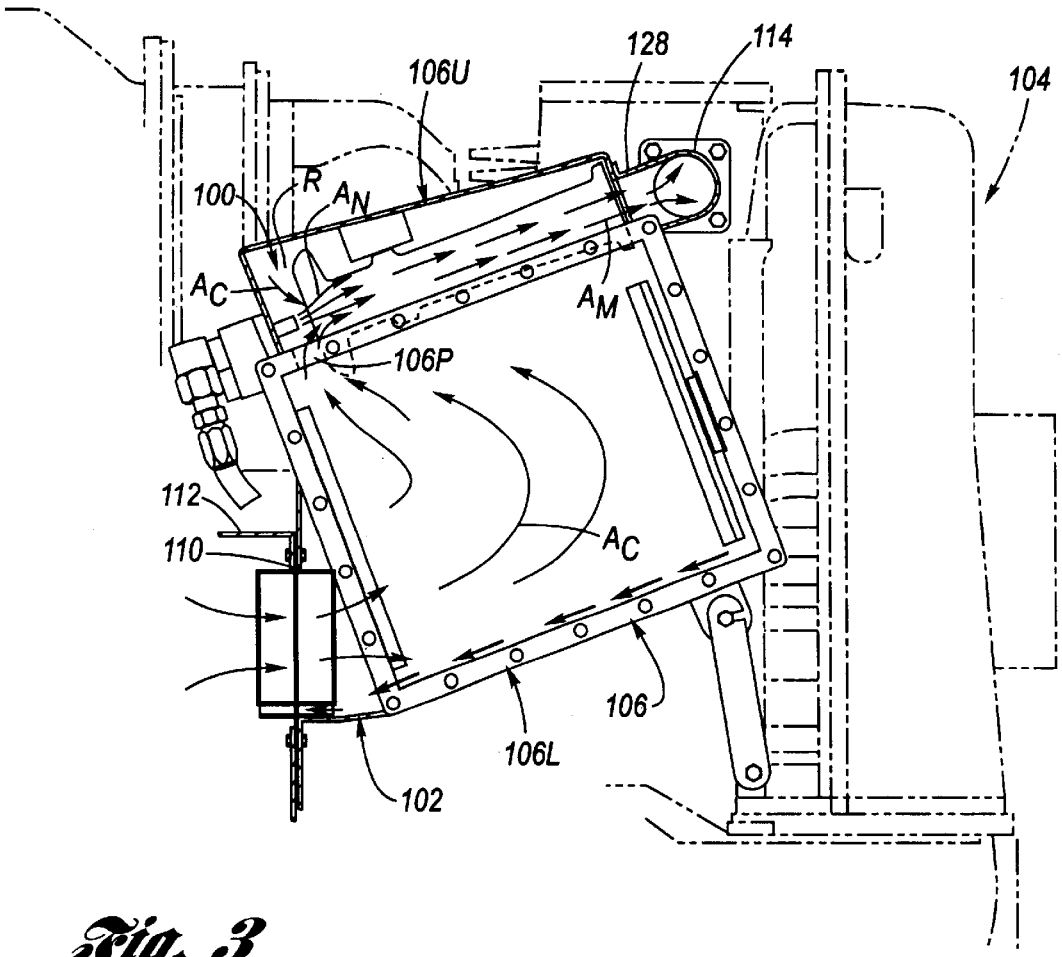
FIG. 3 is a partly sectional side view of the multi-orifice crankcase air evacuator assembly of FIG. 2.

As can be understood from reference to FIGS. 2 and 3, a housing 106 provides a conduit for crankcase air from the crankcase 108 of the diesel engine 104, as for example a crankcase port 110 located at a top portion of the oil pan 112, to an exhaust port 114 which is in communication with the exhaust system of the engine. The housing 106 is a sheet metal fabrication. A lower part 106L of the housing 106 is interfaced with the oil separator 102 upstream of the multi-orifice crankcase air evacuator assembly 100, wherein the multi-orifice crankcase air evacuator assembly is operably interfaced with the housing 106 at an upper part 106U thereof so as to be in communication, at one end thereof, with the oil separator 102 and, at the other end thereof via suitable connection 128, with the exhaust port 114. A high pressure air line 116 is connected to a conventionally derived source of compressed air and to the multi-orifice crankcase air evacuator assembly 100.

Figure 4:
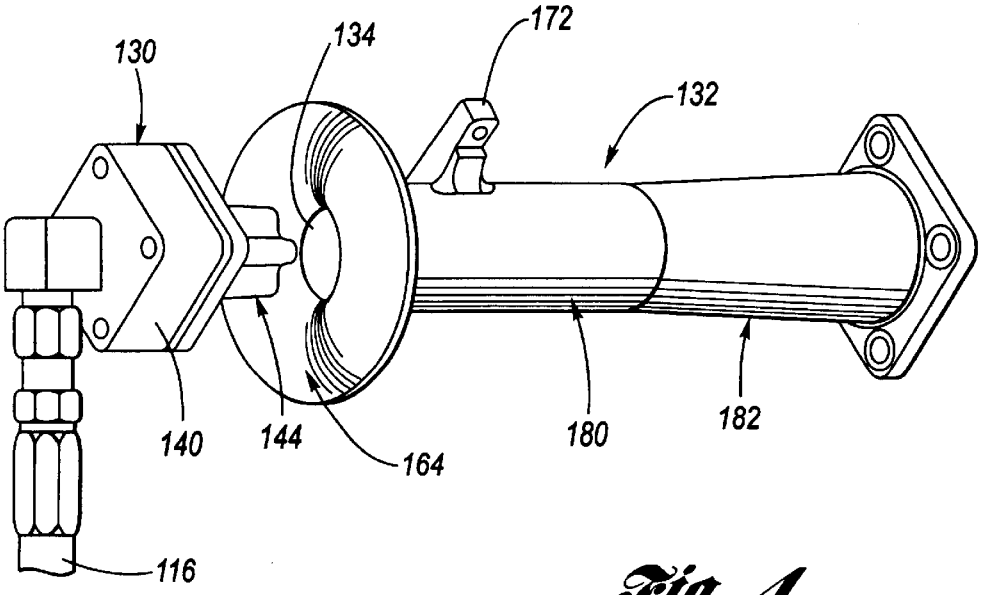
FIG. 4 is a perspective view of the multi-orifice crankcase air evacuator assembly according to the present invention.
Figure 5:
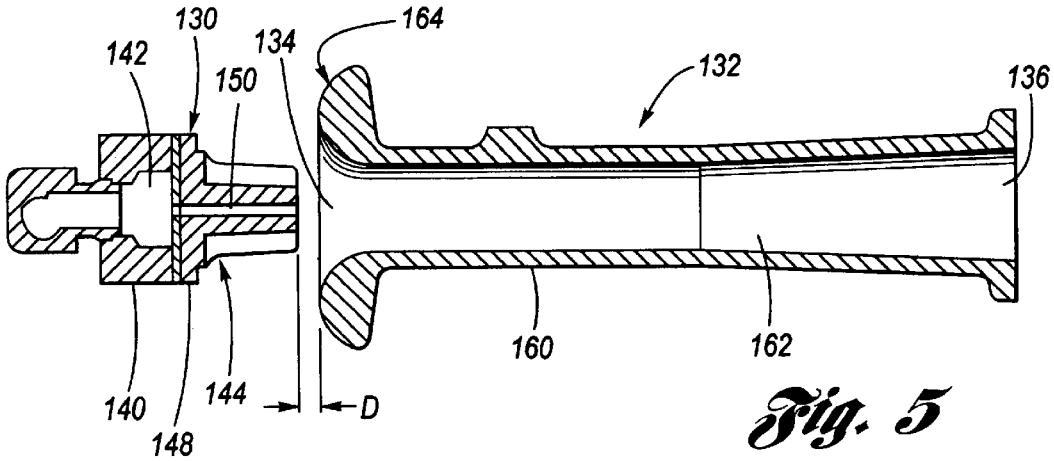
FIG. 5 is a sectional side view of the multi-orifice crankcase air evacuator assembly according to the present invention.
Figure 6A:
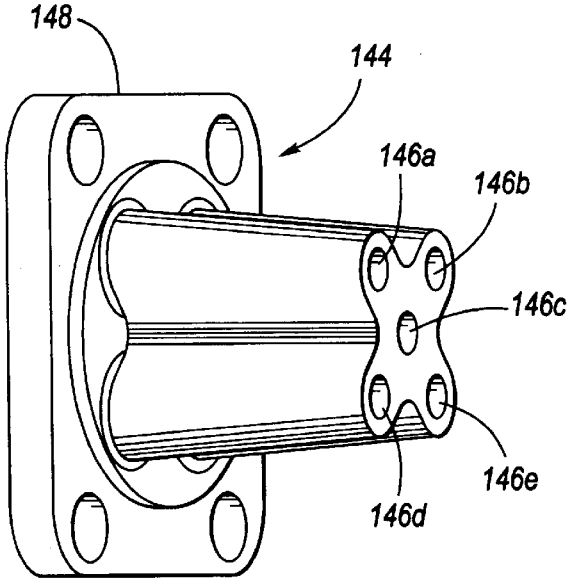
FIG. 6A is a perspective view of a nozzle head of the multi-orifice crankcase air evacuator assembly according to the present invention.
Figure 6B:
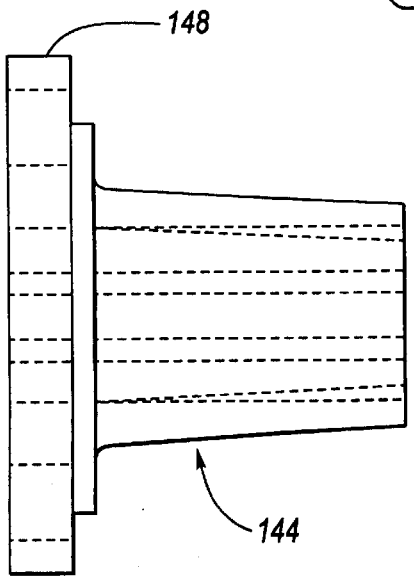
FIG. 6B is a side view of the nozzle head of FIG. 6A.
Figure 6C:
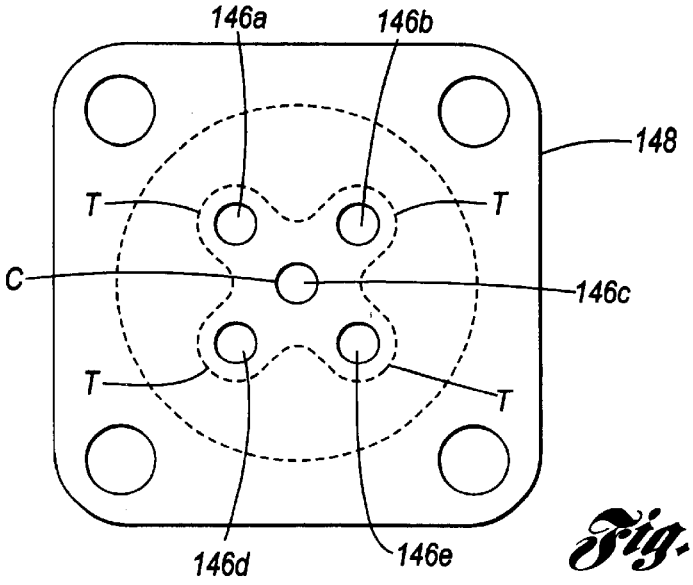
FIG. 6C is a flange end view of the nozzle head of FIG. 6A.

Referring now additionally to FIGS. 4 and 5, the multi-orifice crankcase air evacuator assembly 100 includes a multi-orifice nozzle 130 proximally positioned relative to an inlet 134 of an evacuator tube 132 such that high pressure nozzle air exiting the multi-orifice nozzle 130 passes into the evacuator tube 132, creating a low pressure region therearound which sucks ambient air in the upper part 106U of the housing 106 into the evacuator tube. Since the upper and lower parts 106U, 106L of the housing 106 communicate with each other via a housing passage 106P, because of establishment of the aforementioned the low pressure region, crankcase air from the crankcase port 110 is drawn into the lower part 106L of the housing 106, through the housing passage 106P and into the upper part 106U of the housing so as to be thereupon sucked into the evacuator tube 132. And, since the evacuator tube 132 is, at an outlet 136 thereof, connected to an exhaust port 114 of the engine 104, the crankcase air is expelled to the engine exhaust system.

As shown at FIGS. 4 through 6C, the multi-orifice nozzle 130 includes a nozzle body 140 connected, via the air line 116, to an external source of compressed air. The compressed air enters a nozzle chamber 142 of the nozzle body 140. The multi-orifice nozzle 130 further includes a nozzle head 144 connected with the nozzle body 140. The nozzle head 144 has a plurality of nozzle orifices 146*a*, 146*b*, 146*c*, 146*d*, 146*e* (preferably five in number), wherein each nozzle orifice communicates with the nozzle chamber 142. The nozzle orifices 146*a*–146*e* are mutually spaced in a symmetric arrangement so as to collectively provide a generally circumferential area of air movement as the high pressure nozzle air effuses from the nozzle orifices. It is notable that multiple nozzle orifices provide better gas mixing and movement than can be provided by a single nozzle orifice, resulting in better momentum exchange, and reduction of external air capacity to achieve a similar amount of crankcase air pumping.

By way of preferred example, the multi-orifice nozzle 130 is constructed of a machined aluminum casting. The nozzle head 144 has a nozzle head flange 148 for connecting to the nozzle body 140, and is drilled therethrough to provide an air passageway 150 at each nozzle orifice 146*a*–146*d*. The symmetric arrangement is preferred to be an "X" pattern, wherein a nozzle orifice is located at the center C and each terminous T of each leg of the "X" pattern (see FIG. 6C). For example, an "X" pattern has a separation between the central nozzle orifice 146*c* and the distal nozzle orifices 146*a*, 146*b*, 146*d*, 146*e* along each leg of the "X" of about 0.544 inch, the diameter of each air passageway is about 0.25 inches, and the nozzle head has a length (including the nozzle head flange 148) of about 2.38 inches.

Figure 7A:
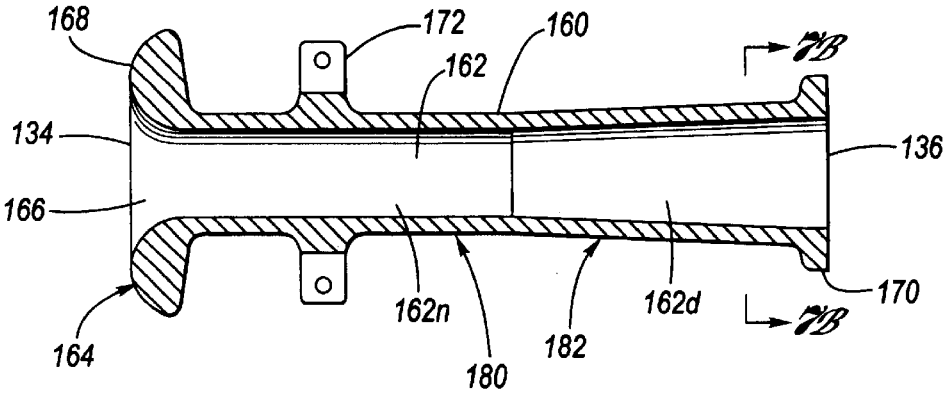
FIG. 7A is a partly sectional side view of the evacuator tube according to the present invention.
Figure 7B:
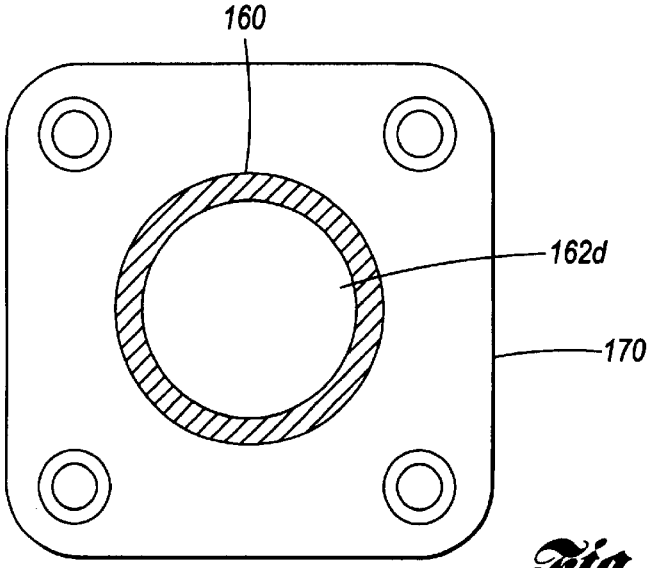
FIG. 7B is a partly sectional view seen along line 7B—7B of FIG. 7A.

Referring now additionally to FIGS. 7A and 7B, the evacuation tube 132 is characterized by a tube body 160 defining a central passage 162 and a bell-mouth 164 integral with the tube body which is concentrically disposed at the inlet 134 thereof. The bell-mouth 164 smoothly merges with the central passage 162 so as to define thereat a throat 166. The bell-mouth 164 has a generally mushroom shape characterized by an annularly distributed convex air guide surface 168. The central passage 162 has a near portion 162*n* which serves as an air mixer 180 and a distal portion 162*d* that widens with increasing distance from the bell-mouth 164 and which serves as an air diffuser 182. The tube body 160 has a mounting flange 170 at the outlet 136 for interfitting with the connection 128 to the exhaust port 114 of the engine 104. Generally, medial of the near portion 162*n*, a cross-bar bracket 172 is connected externally to the tube body 160 for providing a connection of the evacuator tube 102 to the housing 106.

The air guide surface 168 of the bell-mouth 164 allows crankcase air to be sucked into the throat 166 over a 360 degree circumference in response to the high pressure nozzle air rapidly effusing from the nozzle orifices 146*a*–146*e*. Accordingly, a free and voluminous movement of the crankcase air into the throat is achieved. The near portion 162*n* of the central passage 162 provides an air mixing section whereat the nozzle air exchanges momentum with the crankcase air. The distal portion of the central passage serves as a diffuser which serves to recover kinetic energy in the mixed air flow stream.

By way of preferred example, the evacuator tube 102 is composed of a machined aluminum casting. For example, the length of the evacuator tube 102 may be about 14.67 inches, the bell-mouth 164 may have an outer diameter of about 5.6 inches, the near portion 162*n* of the central passage 162 may have a diameter of about 1.7 inches and a length of about 8 inches, and the distal portion 162*d* of the central passage may have a diameter at the outlet 136 of about 2.48 inches. By way of further exemplification, the nozzle orifices 146*a*–146*e* are located in alignment with the central passage 162, in a close spaced proximity to the bell-mouth of, for example, about 0.5 inch (see D in FIG. 5).

Operation of the multi-orifice crankcase air evacuator assembly, will now be described with particular attention being directed to FIG. 3. As high pressure nozzle air $A_N$ rapidly and forcefully exits the nozzle orifices, the respective high velocity air streams converge at the throat and pass rapidly along the central passage. This air movement creates a region R of low pressure surrounding the bell-mouth. Consequently, ambient air of the housing is sucked into the throat at a large rate, thereby causing a pumping movement of the crankcase air $A_C$ out from the crankcase and suckingly into the throat. The crankcase air mixes with the nozzle air streams in the near portion 162*a* of the central passage, causing a momentum mixing therebetween, whereupon crankcase air rapidly moves with the nozzle air streams down the central passage. As this mixed air $A_M$ moves down the central passage, the distal portion 162*b* of the central passage allows expansion and velocity reduction of the mixed air, whereupon the mixed air has generally achieved atmospheric pressure by the time it reaches the outlet of the evacuator tube. The mixed air is then expelled to the exhaust outlet 114.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A multi-orifice crankcase air evacuator assembly for a crankcase ventilation system comprising:

a multi-orifice nozzle comprising a plurality of nozzle orifices; and an evacuator tube comprising a tube body having a central passage, said central passage having an inlet and an opposite outlet; said plurality of nozzle orifices being located proximal to, and in alignment with, said inlet of said central passage;

wherein when air pressurably effuses from said plurality of nozzle orifices, the air passes into said inlet, thereby causing a low pressure region therearound which sucks ambient air into said inlet.

2. The multi-orifice crankcase air evacuator assembly of claim 1, wherein said evacuator tube further comprises a bell-mouth integrally formed of said tube body at said inlet in concentric disposition relative to said central passage, said bell-mouth having an annularly distributed convex air guide surface which smoothly merges with said central passage at said inlet to thereby form a throat.

3. The multi-orifice crankcase air evacuator assembly of claim 2, wherein said central passage comprises a near portion and a distal portion, said near portion extending between said throat and said distal portion, said distal portion extending between said near portion and said outlet, said near portion having a substantially constant diameter serving as an air mixer, said distal portion having an increasing diameter with increasing distance from said near portion serving as an air diffuser.

4. The multi-orifice crankcase air evacuator assembly of claim 1, wherein said multi-orifice nozzle further comprises:

a nozzle body having a nozzle chamber formed therewithin; and a nozzle head connected to said nozzle body;

wherein said plurality of nozzle orifices are formed integrally of said nozzle bead, and wherein each nozzle orifice of said plurality of nozzle orifices comprises an air passageway communicating with said nozzle chamber.

5. The multi-orifice crankcase air evacuator assembly of claim 4, wherein said evacuator tube further comprises a bell-mouth integrally formed of said tube body at said inlet in concentric disposition relative to said central passage, said bell-mouth having an annularly distributed convex air guide surface which smoothly merges with said central passage at said inlet to thereby form a throat.

6. The multi-orifice crankcase air evacuator assembly of claim 5, wherein said central passage comprises a near portion and a distal portion, said near portion extending between said throat and said distal portion, said distal portion extending between said near portion and said outlet, said near portion having a substantially constant diameter serving as an air mixer, said distal portion having an increasing diameter with increasing distance from said near portion serving as an air diffuser.

7. The multi-orifice crankcase air evacuator assembly of claim 6, wherein said plurality of nozzle orifices comprises five nozzle orifices arranged in an "X" pattern.

8. A crankcase ventilation system interfaced between a crankcase port and an exhaust port of a diesel engine, comprising:

a housing connected between the crankcase and exhaust ports of the diesel engine;

a source of compressed air; and a crankcase air evacuator assembly comprising:

a multi-orifice nozzle comprising a plurality of nozzle orifices located within said housing, said multi-orifice nozzle being connected to said source of compressed air, wherein air from said source pressurably effuses as nozzle air from said plurality of nozzle orifices; and an evacuator tube located in said housing, said evacuator tube comprising a tube body having a central passage, said central passage having an inlet and an opposite outlet interconnected with said exhaust port; said plurality of nozzle orifices being located proximal to, and in alignment with, said inlet of said central passage;

wherein said nozzle air passes into said inlet thereby creating a low pressure region therearound which sucks ambient air of said housing into said inlet and thereby evacuates said crankcase air from said crankcase port and expels the crankcase air to said exhaust port.

9. The crankcase ventilation system of claim 8, wherein said evacuator tube farther comprises a bell-mouth integrally formed of said tube body at said inlet in concentric disposition relative to said central passage, said bell-mouth having an annularly distributed convex air guide surface which smoothly merges with said central passage at said inlet to thereby form a throat.

10. The crankcase ventilation system of claim 9, wherein said central passage comprises a near portion and a distal portion, said near portion extending between said throat and said distal portion, said distal portion extending between said near portion and said outlet, said near portion having a substantially constant diameter serving as an air mixer, said distal portion having an increasing diameter with increasing distance from said near portion serving as an air diffuser.

11. The crankcase ventilation system of claim 8, wherein said multi-orifice nozzle further comprises:

a nozzle body connected with said source, said nozzle body having a nozzle chamber formed therewithin, said nozzle chamber communicating with the air from said source; and a nozzle head connected to said nozzle body;

wherein said plurality of nozzle orifices are formed integrally of said nozzle head, and wherein each nozzle orifice of said plurality of nozzle orifices comprises an air passageway communicating with said nozzle chamber.

12. The crankcase ventilation system of claim 11, wherein said evacuator tube further comprises a bell-mouth integrally formed of said tube body at said inlet in concentric disposition relative to said central passage, said bell-mouth having an annularly distributed convex air guide surface which smoothly merges with said central passage at said inlet to thereby form a throat.

13. The crankcase ventilation system of claim 12, wherein said central passage comprises a near portion and a distal portion, said near portion extending between said throat and said distal portion, said distal portion extending between said near portion and said outlet, said near portion having a substantially constant diameter serving as an air mixer, said distal portion having an increasing diameter with increasing distance from said near portion serving as an air diffuser.

14. The crankcase ventilation system of claim 13, wherein said plurality of nozzle orifices comprises five nozzle orifices arranged in an "X " pattern.

15. An evacuator tube for an evacuator of a crankcase ventilation system, comprising:

a tube body having a central passage, said central passage having an inlet and an opposite outlet; and a bell-mouth integrally formed of said tube body at said inlet in concentric disposition relative to said central passage, said bell-mouth having an annularly distributed convex air guide surface which smoothly merges with said central passage at said inlet to thereby form a throat, and wherein said central passage comprises a near portion and a distal portion, said near portion extending between said throat and said distal portion, said distal portion extending between said near portion and said outlet, said near portion having a substantially constant diameter serving as an air mixer, said distal portion having an increasing diameter with increasing distance from said near portion serving as an air diffuser.

* * * * *